US011015472B2

(12) United States Patent
Halfmann et al.

(10) Patent No.: US 11,015,472 B2
(45) Date of Patent: May 25, 2021

(54) TURBINE WHEELS, TURBINE ENGINES INCLUDING THE SAME, AND METHODS OF FORMING TURBINE WHEELS WITH IMPROVED SEAL PLATE SEALING

(71) Applicant: HONEYWELL INTERNATIONAL INC., Morris Plains, NJ (US)

(72) Inventors: Steve Halfmann, Chandler, AZ (US); Daniel C. Crites, Mesa, AZ (US); Michael Kahrs, Phoenix, AZ (US); Ardeshir Riahi, Scottsdale, AZ (US); Jude Miller, Phoenix, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 17/014,547

(22) Filed: Sep. 8, 2020

(65) Prior Publication Data

US 2021/0003023 A1 Jan. 7, 2021

Related U.S. Application Data

(63) Continuation of application No. 16/580,951, filed on Sep. 24, 2019, now Pat. No. 10,851,660, which is a (Continued)

(51) Int. Cl.
*F01D 11/00* (2006.01)
*F01D 5/08* (2006.01)
(Continued)

(52) U.S. Cl.
CPC ..... *F01D 11/006* (2013.01); *F01D 5/081* (2013.01); *F01D 5/3015* (2013.01);
(Continued)

(58) Field of Classification Search
CPC ..... F01D 11/006; F01D 5/3015; F01D 5/081; F01D 5/3023; F01D 5/22; F01D 5/12; F05D 2300/50212; F05D 2230/23
See application file for complete search history.

(56) References Cited

U.S. PATENT DOCUMENTS 2,912,223 A 11/1959 Null, Jr.
3,728,042 A 4/1973 Hugoson et al.
(Continued)

FOREIGN PATENT DOCUMENTS

EP 2762679 A1 8/2014
EP 2937518 A1 10/2015
(Continued)

*Primary Examiner* — Jacob M Amick
*Assistant Examiner* — Charles Brauch
(74) *Attorney, Agent, or Firm* — Lorenz & Kopf, LLP

(57) ABSTRACT

A turbine engine includes a turbine wheel including a rotor disk and turbine blades connected to the rotor disk through blade mounts. The blade mounts and the rotor disk have fore and aft surfaces. The blade mount includes a blade attachment surface connecting the fore and aft surfaces with the turbine blade extending from the blade attachment surface. A gap is defined between and separating adjacent blade mounts and extends into the rotor disk. The gap includes a pocket having a fore opening and a rotor relief hole. The turbine wheel further includes a plug disposed in a rotor relief opening and a pocket seal disposed in the pocket. The turbine engine further includes a fore seal plate having an edge abutting the blade mounts about a circumference of the turbine wheel and a finger extending toward and contacting the plug to maintain the plug in the rotor relief opening.

15 Claims, 5 Drawing Sheets

Related U.S. Application Data continuation of application No. 15/367,735, filed on Dec. 2, 2016, now Pat. No. 10,648,354.

(51) Int. Cl.
*F01D 5/30* (2006.01)
*F01D 5/12* (2006.01)
*F01D 5/22* (2006.01)

(52) U.S. Cl.
CPC ..... *F01D 5/3023* (2013.01); *F01D 5/12* (2013.01); *F01D 5/22* (2013.01); *F05D 2230/23* (2013.01); *F05D 2300/50212* (2013.01)

(56) References Cited

U.S. PATENT DOCUMENTS

| | | | | |
|---|---|---|---|---|
| 3,847,506 | A | 11/1974 | Straniti | |
| 6,086,329 | A | 7/2000 | Tomita et al. | |
| 6,273,683 | B1 | 8/2001 | Zagar et al. | |
| 7,367,123 | B2 | 5/2008 | Itzel et al. | |
| 7,575,416 | B2 | 8/2009 | Funk et al. | |
| 7,762,780 | B2 | 7/2010 | Decardenas | |
| 8,322,977 | B2 | 12/2012 | Beeck | |
| 8,393,869 | B2 | 3/2013 | Kim et al. | |
| 8,540,486 | B2 | 9/2013 | Johnson | |
| 8,573,942 | B2 | 11/2013 | Strohl et al. | |
| 8,684,695 | B2 | 4/2014 | Walunj et al. | |
| 8,790,086 | B2 | 7/2014 | Honkomp et al. | |
| 8,820,754 | B2 | 9/2014 | Stewart et al. | |
| 8,905,715 | B2 | 12/2014 | Boyer et al. | |
| 8,967,974 | B2 | 3/2015 | Garcia-Crespo | |
| 9,133,720 | B2 * | 9/2015 | Suciu | F01D 5/34 |
| 9,273,563 | B2 * | 3/2016 | Suciu | F04D 29/321 |
| 2005/0220619 | A1 | 10/2005 | Self et al. | |
| 2006/0177312 | A1 | 8/2006 | Tomita et al. | |
| 2011/0217175 | A1 | 9/2011 | Tochitani et al. | |
| 2011/0255991 | A1 * | 10/2011 | Borufka | F01D 5/34 416/97 R |
| 2012/0045337 | A1 | 2/2012 | Fedor et al. | |
| 2013/0108445 | A1 | 5/2013 | Suciu et al. | |
| 2014/0030100 | A1 | 1/2014 | Joshi et al. | |
| 2014/0161590 | A1 | 6/2014 | Stiehler et al. | |
| 2015/0204194 | A1 | 7/2015 | Tapia et al. | |
| 2016/0032751 | A1 | 2/2016 | Snyder | |
| 2016/0069203 | A1 * | 3/2016 | Aiello | F01D 5/3007 416/219 R |

FOREIGN PATENT DOCUMENTS

| | | | |
|---|---|---|---|
| EP | 2987953 | A2 | 2/2016 |
| EP | 3091190 | A1 | 11/2016 |

* cited by examiner

TURBINE WHEELS, TURBINE ENGINES INCLUDING THE SAME, AND METHODS OF FORMING TURBINE WHEELS WITH IMPROVED SEAL PLATE SEALING

CROSS REFERENCE TO RELATED APPLICATIONS

The subject application is a continuation of U.S. patent application Ser. No. 16/580,951 filed on Sep. 24, 2019, which is a continuation of U.S. patent application Ser. No. 15/367,735 filed on Dec. 2, 2016, the contents of which are incorporated herein by reference in their entirety.

TECHNICAL FIELD

The technical field generally relates to turbine wheels, turbine engines including the turbine wheels, and methods of forming the turbine wheels, and more particularly relates to turbine wheels having improved seal plate sealing for bonded turbine blade/rotor disk configurations.

BACKGROUND

Gas turbine engines are generally known for use in a wide range of applications such as aircraft engines and auxiliary power units for aircraft. In a typical configuration, the gas turbine engine includes a turbine section having a plurality of sets or rows of stator vanes and turbine blades disposed in an alternating sequence along an axial length of a hot gas flow path of generally annular shape. The turbine blades are coupled to a main engine shaft through one or more rotor disks. Hot combustion gases are delivered from an engine combustor to the annular hot gas flow path, resulting in rotary driving of the turbine rotor disks which, in turn, drives the compressors and gearbox.

Advanced high performance gas turbine engines, such as high pressure turbines (HPTs) are constantly driven to achieve maximized thermodynamic efficiency, which is generally achieved by operating at higher rotor speeds and temperatures. In many gas turbine engine configurations, especially for HPTs, the turbine blades are mounted at the periphery of the one or more rotor disks through a mechanical connection, e.g., through a dovetail-type connection or the like. However, the mechanical properties of the rotor disks and turbine blades may be inadequate to sustain induced loads during operation, even with selection of special materials and engineered cooling schemes. This may be especially true as efforts are made to maximize thermodynamic efficiency by maximizing rotor speeds and operating temperatures.

One approach taken to maximize temperatures and load carrying capability in turbine blades and rotor disks, particularly in HPTs is to employ dissimilar materials for the rotor disks and the turbine blades while removing the stress concentrations associated to mechanical connections. The respective rotor disks and turbine blades, including the dissimilar materials, are directly bonded together as opposed to relying upon a mechanical connection. In one example, the turbine blades may be operatively connected to blade mounts, e.g., by casting the turbine blades and blade mounts together, or by brazing or welding the turbine blades to the blade mounts. The blade mounts may be operatively connected to each other forming a blade ring, such as by casting a plurality of blade mounts together or by brazing or welding blade mounts together. However, the creation of an integral bonded rotor requires the release of hoop stress attributable to the thermal gradients and rotation of the rotor disk. The hoop stress can be broken by slotting the blade ring and rotor disk after bonding the blade ring and rotor disk together.

In addition, it is often desirable to regulate the normal operating temperature of certain turbine components in order to prevent overheating. That is, while engine stator vanes and turbine blades are specially designed to function in the high temperature environment of the mainstream hot gas flow path, other turbine components such as the rotor disks are not generally designed to withstand such high temperatures. Accordingly, in many gas turbine engines, the volumetric space disposed radially inwardly or internally from the hot gas flow path includes a fore seal plate, and an aft seal plate is also generally disposed on an opposite side of the turbine wheel from the fore seal plate. The fore and aft seal plates form respective fore and aft rotating internal engine cavities around the rotor disk(s). The internal engine cavities are sealed from direct contact with the high temperature environment of the mainstream hot gas flow path, sometimes with a cooling air flow provided therethrough. When provided, the cooling air flow is normally obtained as a bleed flow from a compressor or compressor stage forming a portion of the gas turbine engine. The internal engine cavities enable a normal steady state temperature of the rotor disks and other internal engine components to be maintained at or below a temperature of the high temperature environment.

With bonded turbine blade/rotor disk configurations that are slotted to relieve hoop stress, sealing of the internal engine cavities is often imperfect, resulting in excessive intrusion of high temperature gas from the mainstream hot gas flow path into the internal engine cavities or an excessive use of parasitic cooling air. While attempts have been made to seal the internal engine cavities, the configuration of the slots can complicate complete sealing using seal plates.

Accordingly, it is desirable to provide turbine wheels, turbine engines including the turbine wheels, and methods of forming the turbine wheels having improved seal plate sealing for bonded turbine blade/rotor disk configurations. Furthermore, other desirable features and characteristics will become apparent from the subsequent detailed description and the appended claims, taken in conjunction with the accompanying drawings and this background.

BRIEF SUMMARY

A turbine engine is disclosed. The turbine engine comprises a turbine wheel including a rotor disk, a plurality of turbine blades each operatively connected to the rotor disk through a blade mount with the blade mount bonded to the rotor disk and the blade mount and the rotor disk having a fore surface on a higher pressure side thereof and an aft surface on a lower pressure side thereof, wherein the blade mount comprises a blade attachment surface extending between and connecting the fore surface and the aft surface thereof with the turbine blade extending from the blade attachment surface; a gap defined between adjacent blade mounts separating the blade mounts and extending into the rotor disk with the gap including a pocket having a fore opening in the fore surface and the gap further including a rotor relief hole defined by and within the rotor disk and having a rotor relief opening in the fore surface, a plug disposed in the rotor relief opening, and a pocket seal disposed in the pocket. The turbine engine further comprises a fore seal plate having a fore plate edge abutting the blade mounts about a circumference of the turbine wheel and a finger extending toward and contacting the plug to maintain the plug in the rotor relief opening.

BRIEF DESCRIPTION OF THE DRAWINGS

The various embodiments will hereinafter be described in conjunction with the following drawing figures, wherein like numerals denote like elements, and wherein.

DETAILED DESCRIPTION

Figure 1:
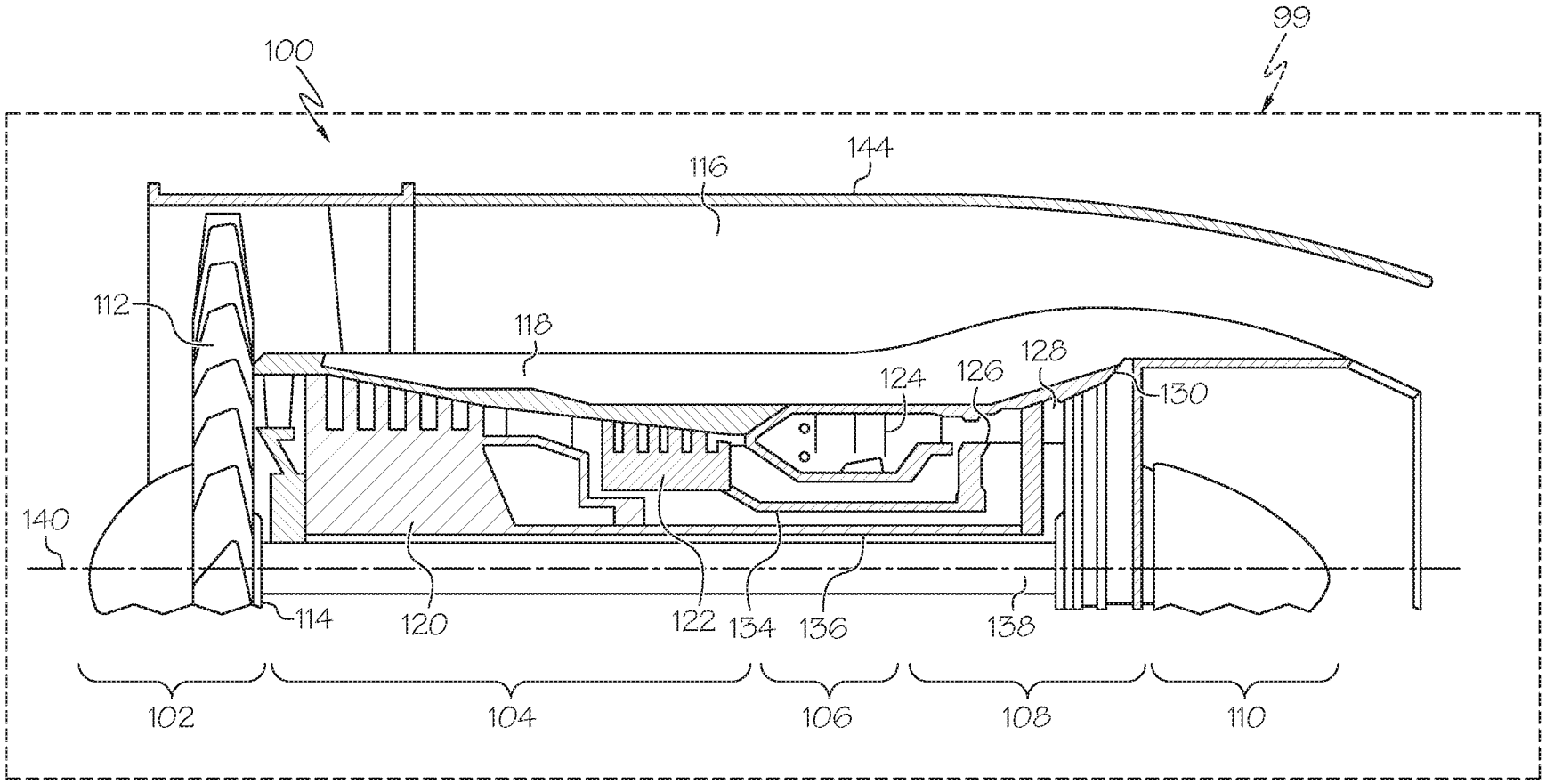
FIG. 1 is a schematic partial, cross-sectional view of an exemplary turbine engine accordance with an embodiment.

The following detailed description is merely exemplary in nature and is not intended to limit the turbine wheels, turbine engines including the turbine wheels, and methods of forming the turbine wheels as described herein. Furthermore, there is no intention to be bound by any theory presented in the preceding background or the following detailed description.

Embodiments of the present disclosure are generally directed to turbine wheels, turbine engines, and methods of forming the turbine wheels. For the sake of brevity, conventional techniques related to turbine engine design and fabrication may not be described in detail herein. Moreover, the various tasks and process steps described herein may be incorporated into a more comprehensive procedure or process having additional steps or functionality not described in detail herein. In particular, turbine wheels, turbine engines, and methods of forming turbine wheels are well-known and so, in the interest of brevity, many conventional steps will only be mentioned briefly herein or will be omitted entirely without providing the well-known process details.

The turbine wheel may be useful in any gas turbine engine, and may be particularly useful in high pressure turbine (HPT) engines or HPT sections of the gas turbine engines. The turbine wheel and turbine engines may be used in many industries including aerospace and industrial such as for applications including electricity generation, naval propulsion, pumping sets for gas and oil transmission, aircraft propulsion, automobile engines, and stationary power plants.

The turbine wheels, turbine engines, and methods of forming the turbine wheels as described herein provide improved seal plate sealing for bonded turbine blade/rotor disk configurations. In one example, the turbine wheel includes a plurality of turbine blades each operatively connected to a rotor disk through a blade mount. "Operatively connected," as referred to herein, means that the referenced parts are connected by casting the parts together, by brazing or welding the parts together, or by otherwise bonding the parts together in the absence of a mechanical connection such as dovetails, keyhole connections, or the like where physical contours or frictional forces maintain the connection between the parts, The blade mounts, as referred to herein, are portions of the turbine wheel that include a single turbine blade and that are directly bonded to the rotor disk. The blade mounts and rotor disk are formed from dissimilar materials, i.e., materials having a different coefficient of thermal expansion, due to design and operating environment considerations. To form the turbine wheels, the blade mounts may be bonded or cast together to form a blade ring, followed by bonding the blade ring to the rotor disk. Due to bonding of the dissimilar materials, thermal gradients, and the rotation induced stress in the unbroken ring, hoop stress arises in the blade ring and the rotor disk. To relieve the hoop stress, the blade ring and the rotor disk are slotted along a radius thereof, i.e., a common radius of the rotor disk and the blade mount, to thereby form a gap between adjacent blade mounts, with the gap separating the blade mounts and extending into the rotor disk. The gap includes a pre-formed pocket defined in and between adjacent blade mounts to enable effective release of the hoop stress through slotting, with the pre-formed pocket formed prior to slotting. The pocket has a fore opening in a fore surface of the blade mounts and, optionally, an aft opening in an aft surface of the blade mounts. The turbine engine includes a fore seal plate having a fore plate edge abutting the blade mounts about the circumference of the turbine wheel. Given the presence of the fore opening in the pre-formed pocket, poor sealing of the fore plate edge to the blade mounts can result. Thus, a pocket seal is disposed in the pocket to assist with sealing of the fore plate edge to the blade mounts, thereby further isolating a cavity between the fore seal plate and the turbine wheel from an environment surrounding the turbine blades during operation of the turbine engine.

With reference to FIG. 1, a partial, cross-sectional view of an exemplary turbine engine 100 is shown with the remaining portion of the turbine engine 100 being axi-symmetric about a longitudinal axis 140, which also includes an axis of rotation for the gas turbine engine 100. In the depicted embodiment, the turbine engine 100 is an annular multi-spool turbofan gas turbine jet engine 100 within an aircraft 99, although other arrangements and uses may be provided. Components of the gas turbine engine 100 may be, for example, also found in an auxiliary power unit ("APU").

In this example, the turbine engine 100 includes a fan section 102, a compressor section 104, a combustor section 106, a turbine section 108, and an exhaust section 110. The fan section 102 includes a fan 112 mounted on a rotor 114 that draws air into the gas turbine engine 100 and accelerates it. A fraction of the accelerated air exhausted from the fan 112 is directed through an outer (or first) bypass duct 116 and the remaining fraction of air exhausted from the fan 112 is directed into the compressor section 104. The outer bypass duct 116 is generally defined by an inner casing 118 and an outer casing 144. In the embodiment of FIG. 1, the compressor section 104 includes an intermediate pressure compressor 120 and a high pressure compressor 122. However, in other embodiments, the number of compressors in the compressor section 104 may vary. In the depicted embodiment, the intermediate pressure compressor 120 and the high pressure compressor 122 sequentially raise the pressure of the air and direct a majority of the high pressure air into the combustor section 106. A fraction of the compressed air bypasses the combustor section 106 and is used to cool, among other components, turbine blades in the turbine section 108 via an inner bypass duct.

In the embodiment of FIG. 1, in the combustor section 106, which includes a combustion chamber 124, the high pressure air is mixed with fuel and combusted. The high-temperature combusted air is then directed into the turbine section 108. In this example, the turbine section 108 includes three turbines disposed in axial flow series, namely, a high pressure turbine 126, an intermediate pressure turbine 128, and a low pressure turbine 130. However, it will be appreciated that the number of turbines, and/or the configurations thereof, may vary. In this embodiment, the high-temperature combusted air from the combustor section 106 expands through and rotates each turbine 126, 128, and 130. As the turbines 126, 128, and 130 rotate, each drives equipment in the gas turbine engine 100 via concentrically disposed shafts or spools. In one example, the high pressure turbine 126 drives the high pressure compressor 122 via a high pressure shaft 134, the intermediate pressure turbine 128 drives the intermediate pressure compressor 120 via an intermediate pressure shaft 136, and the low pressure turbine 130 drives the fan 112 via a low pressure shaft 138.

Figure 2:
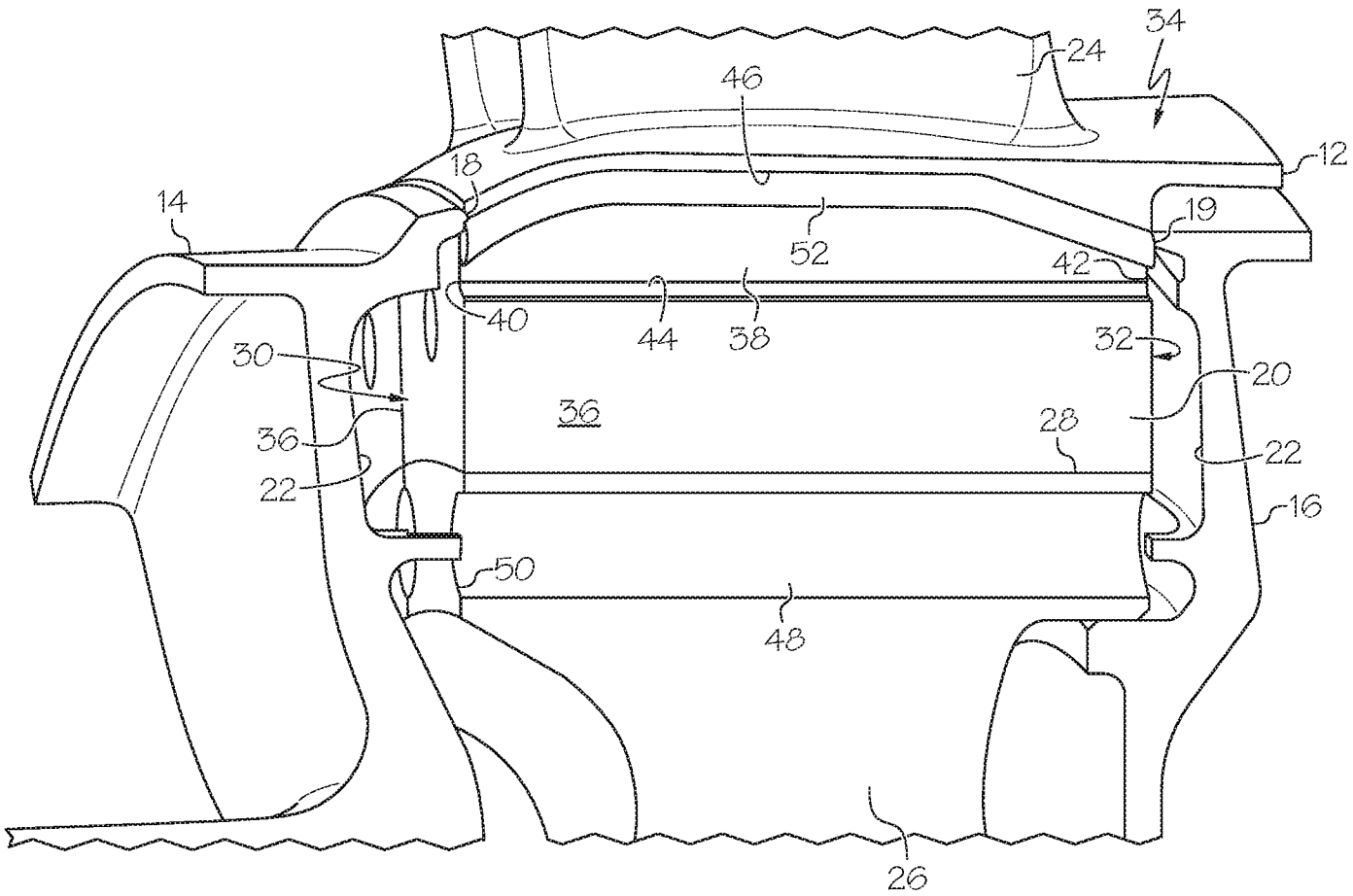
FIG. 2 is a cut-away three-dimensional side view of a portion of the turbine engine of FIG. 1 in accordance with an embodiment.
Figure 3:
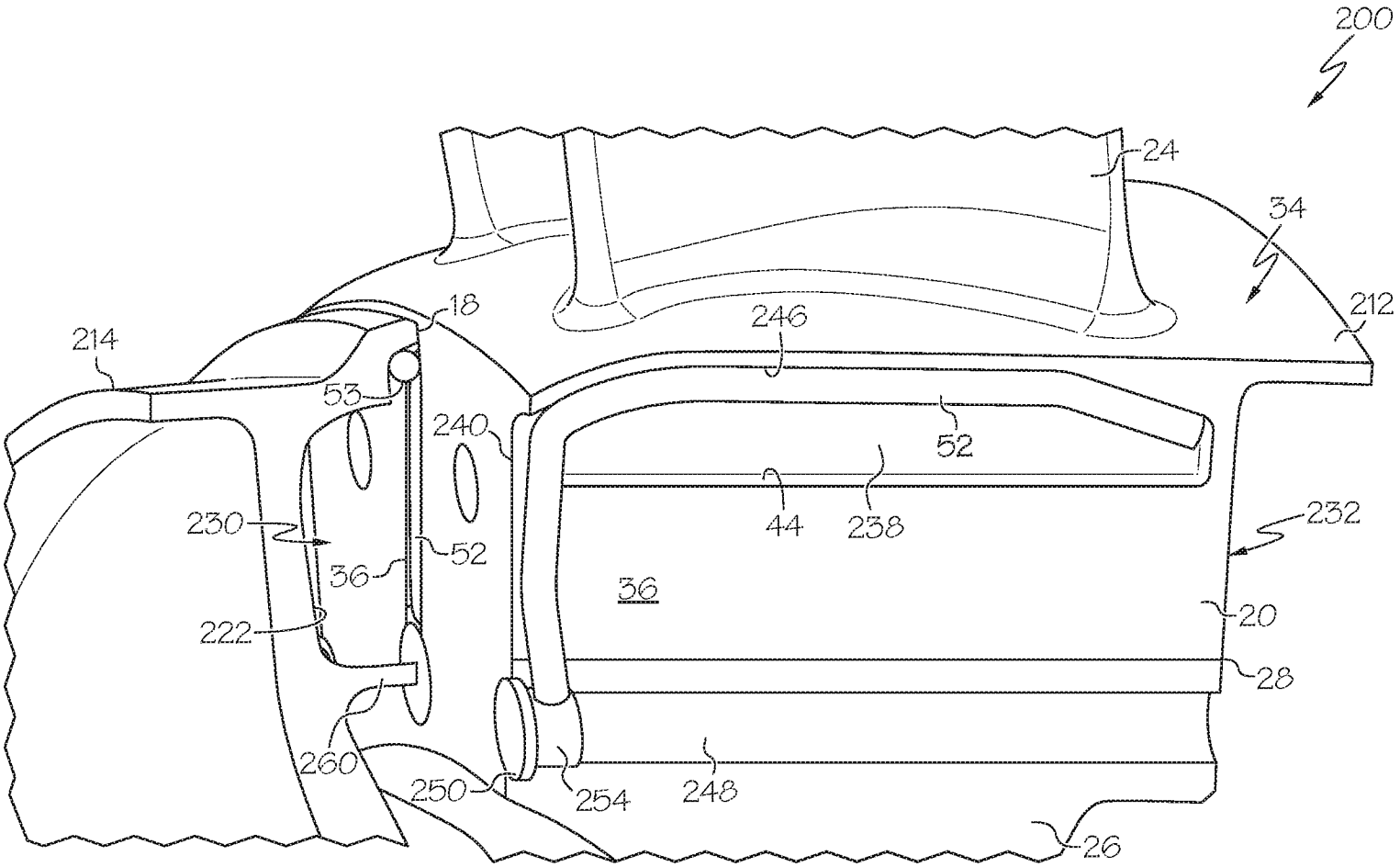
FIG. 3 is a cut-away three-dimensional side view of a portion of the turbine engine of FIG. 1 in accordance with another embodiment.
Figure 4:
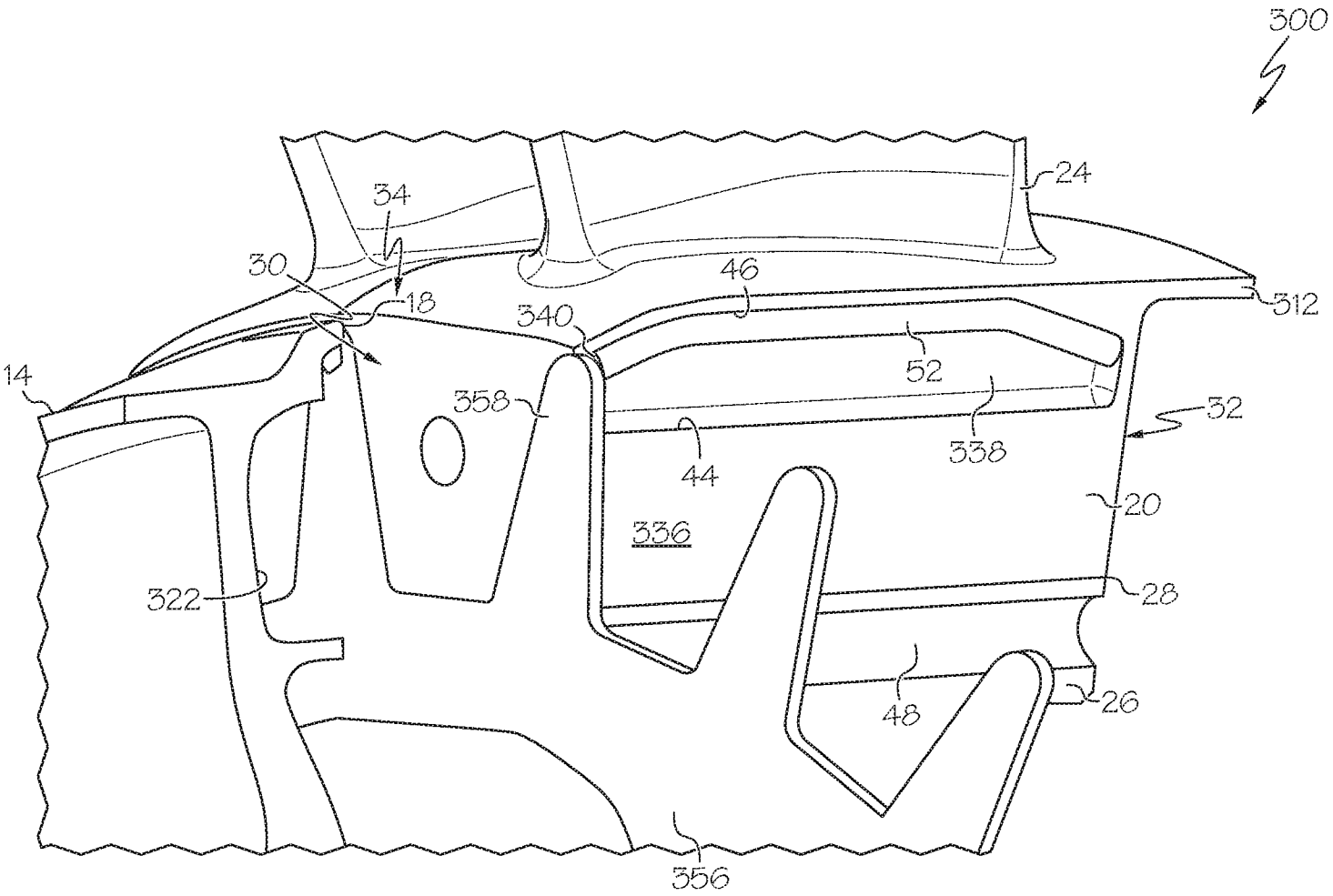
FIG. 4 is a cut-away three-dimensional side view of a portion of the turbine engine of FIG. 1 in accordance with another embodiment.
Figure 5:
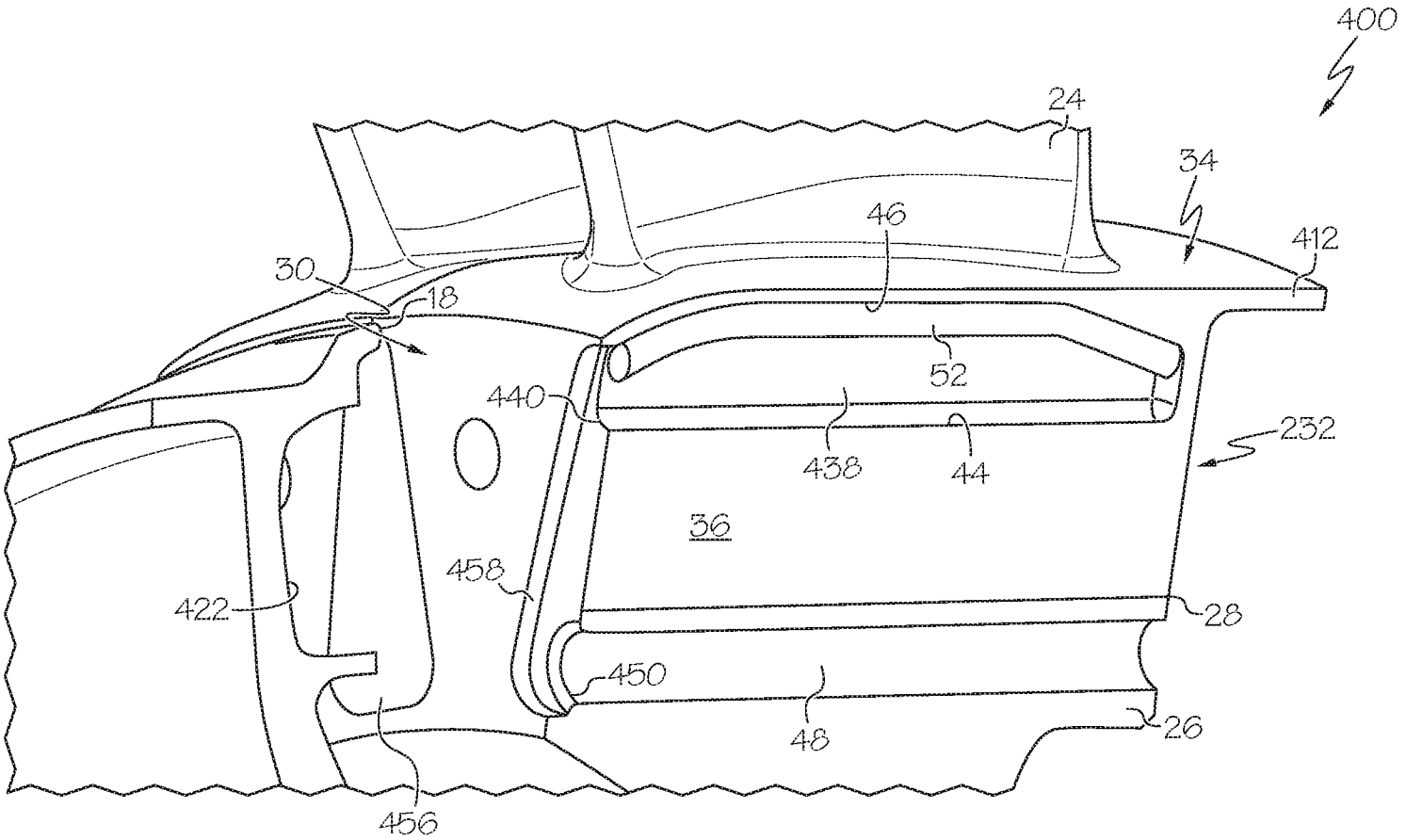
FIG. 5 is a cut-away three-dimensional side view of a portion of the turbine engine of FIG. 1 in accordance with another embodiment.

Referring to FIG. 2, a section of the turbine engine 100 that includes a turbine wheel 12 and a fore seal plate 14 will now be described in detail. As alluded to above, the turbine wheel 12 and the fore seal plate 14 may be located in the high pressure turbine 126 of the turbine engine 100. In the embodiment shown in FIG. 2, the turbine engine 100 further includes an aft seal plate 16, although it is to be appreciated that the aft seal plate may be omitted in other embodiments as described in further detail below and as shown in FIGS. 3-5. Referring again to FIG. 2, the fore seal plate 14, which is located on an upstream, a higher pressure side of the turbine wheel 12 hereinafter referred to as the "fore side," has a fore plate edge 18 that abuts blade mounts 20 about the circumference of the turbine wheel 12. In embodiments, the fore seal plate 14 and the turbine wheel 12 define a cooling cavity 22 therebetween. The cooling cavity 22 is in fluid communication with a cooling fluid source (not shown) that is isolated from a gaseous environment surrounding the turbine blades 24 during operation of the turbine engine 100. Further, the cooling cavity 22 is sealed from gaseous communication between the cooling cavity 22 and the gaseous environment surrounding the turbine blades 24, e.g., by the fore plate edge 18 in cooperation with a fore surface of the blade mounts 20 and other features that are described in further detail below. In embodiments and as shown in FIG. 2, the aft seal plate 16 has an aft plate edge 19 that abuts the blade mounts 20 about the circumference of the turbine wheel 12, on a downstream, lower pressure side of the turbine wheel hereinafter referred to as the "aft side."

Referring again to FIG. 2, the turbine wheel 12 includes a rotor disk 26 and a plurality of the turbine blades 24. Each turbine blade 24 is operatively connected to the rotor disk 26 through a respective blade mount 20, with the bond between the rotor disk 26 and the respective blade mounts 20 shown at bond line 28. The turbine wheel 12 may be formed by providing the turbine blades 24 operatively connected to the respective blade mounts 20, e.g., by casting the turbine blades 24 and blade mounts 20 together, or by brazing or welding the turbine blades 24 to the blade mounts 20. In one example, the turbine blades 24 and respective blade mounts 20 are unitary and do not rely upon a mechanical connection to remain joined. A plurality of the blade mounts 20 are operatively connected to form a blade ring, e.g., by casting the blade mounts 20 together to form the blade ring or brazing or welding the blade mounts 20 together, followed by bonding the blade ring to the rotor disk 26 at the bond line 28.

The blade mount 20 and the rotor disk 26 have a fore surface 30 on the fore side of the turbine wheel 12, and the blade mount 20 and the rotor disk 26 have an aft surface 32 on the aft side of the turbine wheel 12. The fore surface 30 and the aft surface 32 are opposite and generally parallel to each other. The blade mount 20 further includes a blade attachment surface 34 that extends between and connects the fore surface 30 and the aft surface 32. The turbine blade 24 extends from the blade attachment surface 34 of each blade mount 20.

A gap 36 is defined between adjacent blade mounts 20. In one example, the gap 36 separates the blade mounts 20 and extends into the rotor disk 26. The gap 36, as referred to herein, is an interface between surfaces of adjacent blade mounts 20, and the surfaces of the adjacent blade mounts 20 may be in direct physical contact at various points thereal-ong, but are not bonded to each other. The gap 36 may be formed by slotting a blade ring of blade mounts 20 after bonding the blade ring to the rotor disk 26 during formation of the turbine wheel 12 to release hoop stress. The gap 36 includes a pocket 38 that has a fore opening 40 in the fore surface 30. An opening into the pocket 38, as referred to herein, is a cavity through which seal material can effectively be moved into the pocket. In embodiments and as shown in FIG. 2, the fore opening 40 is located in a contact area where the fore plate edge 18 of the fore seal plate 14 meets the blade mount 20. Each pocket 38 is defined in and between adjacent blade mounts 20. In this regard, during slotting of the blade ring during formation of the turbine wheel 12, blade ring may be slotted through the pocket 38 of adjacent blade mounts 20. In embodiments, the pocket 38 is fully contained within and between adjacent blade mounts 20, i.e., the pocket is not defined in any way by the rotor disk 26. In embodiments, only the fore opening 40 and, optionally, an aft opening 42 lead to the pocket 38. The pocket 38 is free from an opening in the blade attachment surface 34 of the blade mount 20. In this example, while the gap 36 between the adjacent blade mounts 20 opens to the blade attachment surface 34, the pocket 38 has no opening to the blade attachment surface 34. Although the gap 36 formed at the interface between adjacent blade mounts 20 leads to the pocket 38, the gap 36 is not an opening for purposes herein because effective ingress and egress of seal material into the pocket is impossible through the gap 36.

Referring again to FIG. 2, in embodiments, the pocket 38 has a radially inward surface 44 proximal the rotor disk 26 and a radially outward surface 46 distal the rotor disk 26, proximal the turbine blade 24. The pocket 38 may be machined in the blade mount 20 prior to or after fabrication of the blade ring during formation of the turbine wheel 12. The pocket 38 may also be cast in the blade mount 20 during casting of an individual blade mount 20, casting of an individual blade mount 20 and turbine blade 24, or casting of a plurality of turbine blades 24 and blade mounts 20 constituting a blade ring. FIG. 2 illustrates the pocket 38 with one of the blade mounts removed to show the gap 36. In this regard, the pocket 38 may be defined by adjacent blade mounts 20, with each respective blade mount 20 defining a portion of the pocket 38.

In embodiments and as shown in FIG. 2, the gap 36 further includes a rotor relief hole 48 in the rotor disk 26. In this example, whereas the pocket 38 is defined by and within the blade mount(s) 20, the rotor relief hole 48 is defined by and within the rotor disk 26. The rotor relief hole 48 has a rotor relief opening 50 in the fore surface 30. The rotor relief hole 48 may be present for similar reasons as the pocket 38. In embodiments and as shown in FIG. 2, the rotor relief hole 48 is separate and spaced apart from the pocket 38 in the blade mount 20, i.e., the rotor relief hole 48 is exclusively defined by and within the rotor disk 26 with no internal channels within the blade mount 20 and the rotor disk 26 between the pocket 38 and the rotor relief hole 48.

In embodiments, a pocket seal 52 is disposed in the pocket 38. For example, the pocket seal 52 is at least disposed along the radially outward surface 46, thereby effectively sealing the gap 36 at the radially outward surface 46. However, it is to be appreciated that the pocket seal 52 may fill the entire pocket 38. In embodiments and as shown in FIG. 2, the pocket seal 52 extends to the fore opening 40. By "extending to the opening," as described herein, it is meant that the pocket seal 52 may be substantially flush with the fore surface 30 and terminates at the fore opening 40 or slightly outside of the pocket 38 at the fore opening 40. As set forth above, in embodiments, the fore opening 40 is located in the contact area where the fore plate edge 18 of the fore seal plate 14 meets the blade mount 20. Thus, by extending to the fore opening 40, the pocket seal 52 enables sealing engagement of the pocket seal 52 with the fore seal plate 14, for example, the fore plate edge 18. In this regard, in embodiments the fore opening 40 is aligned with the fore plate edge 18, i.e., the fore opening 40 at least partially overlaps with the fore plate edge 18, and the pocket seal 52 contacts the fore plate edge 18 to effectively seal the pocket 38. In an embodiment and as shown in FIG. 2, the pocket 38 further includes the aft opening 42 in the aft surface 32, and the pocket seal 52 further extends to the aft opening 42 to effectively seal the pocket 38 on the aft side 32 of the turbine wheel 12 as well.

In embodiments, the pocket seal 52 is formed in the pocket 38 through at least one of the fore opening 40 or the aft opening 42. For example, the pocket seal 52 may be formed by inserting a wire into the pocket 38, blowing a powdered metal into the pocket 38, spraying molten metal into the pocket, or the like. The pocket seal 52 may include metal, i.e., a material with properties characteristic of a metal such as malleability. However, it is to be appreciated that the pocket seal 52 may be formed from any material that can conform to the radially outward surface 46 under centripetal force and heat while resisting breakdown. For example, in embodiments, the pocket seal 52 is formed from L605, Haynes 188, or Hastelloy X.

In the embodiment shown in FIG. 2, the cooling cavity 22 is defined on both the fore side and the aft side of the turbine wheel 12, with fluid communication between the fore side and the aft side facilitated through the rotor relief hole 48 and through portions of the pocket 38 that are not sealed with the pocket seal 52. The pocket seal 52 effectively seals the cooling cavity 22 from intrusion of hot gases into the cooling cavity 22, and further seals the cooling cavity 22 from excessive leakage of cooling gas out of the cooling cavity 22. Leakage of cooling gas from the cooling cavity 22 may reduce efficiency of the turbine engine 100.

In another embodiment of a turbine engine 200 and referring to FIG. 3, the turbine engine 200 is substantially similar to the turbine engine 100 of FIG. 2. However, in this embodiment, the rotor relief hole 248 is connected to the pocket 238 internally between the blade mount 20 and the rotor disk 26. As shown in FIG. 3, the aft seal plate may be omitted with no gas flow from an internal cavity 222 formed between the fore seal plate 214 and the fore surface 230 of the turbine wheel 212 to the aft side of the turbine wheel 212. In this embodiment, the pocket 238 is free from an aft opening in the aft surface 232. Rather, in this embodiment, the pocket 238 may include only the fore opening 240 into the pocket 238 to enable insertion of the pocket seal 52 into the pocket 238, and a plug 254 may be disposed in the rotor relief opening 250. A finger 260 may extend from the fore seal plate 214 and contact the plug 254 to maintain the plug 254 in place. The pocket seal 252 further extends to the rotor relief hole 248, and the plug 254 may contact the pocket seal 252. An optional radial seal 53 may be provided, with the radial seal 53 seated between the fore seal plate 214 and the blade mounts 20, adjacent the fore plate edge 18 and abutting the pocket seal 52 to enhance sealing at the fore plate edge 18 when the radial seal 53 is present. Similarly, although not shown, when the aft seal plate is present and when pocket includes the aft opening, an optional aft radial seal may be similarly situated as the radial seal 53. The turbine wheel 212 of this embodiment may be an uncooled turbine wheel, where the internal cavity 222 is uncooled and effectively provides an insulating buffer.

In another embodiment of a turbine engine 300 and referring to FIG. 4, a variation of the embodiment shown in FIG. 3 is illustrated with the turbine engine 300 substantially similar to the turbine engine 200 of FIG. 3. However, in this embodiment, a plate seal 356 covers the rotor relief opening (not shown in FIG. 4) and the fore opening 340 of the pocket 338. In this embodiment, the plate seal 356 includes a ring that has projections 358, wherein each projection 358 covers a respective rotor relief opening and fore opening 340 of one gap 336 about a circumference of the turbine wheel 312. In embodiments, the plate seal 356 is seated in a recess (not shown) that is defined by the rotor disk 26 and blade mounts 20 in the fore surface 30 such that the plate seal 356, when installed, is substantially flush with the fore surface 30. Like the embodiment of FIG. 3, the aft seal plate may be omitted and the turbine wheel 312 of this embodiment may be an uncooled turbine wheel, where the internal cavity 322 is uncooled and effectively provides an insulating buffer.

In another embodiment of a turbine engine 400 and referring to FIG. 5, another variation of the embodiment shown in FIG. 3 is illustrated with the turbine engine 300 substantially similar to the turbine engine 200 of FIG. 3. However, in this embodiment, a plate seal 456 covers the rotor relief opening 450 and the fore opening 440 of the pocket 438. In this embodiment, the plate seal 456 only covers one rotor relief opening 450 and fore opening 440 pair, and a plurality of plates may be employed to cover each rotor relief opening 450 and fore opening pair 440. In embodiments, the plate seals 456 are seated in respective recesses 458 that are defined by the rotor disk 26 and blade mounts 20 in the fore surface 30 such that the plate seals 356, when installed, are substantially flush with the fore surface 30. Like the embodiment of FIG. 4, the aft seal plate may be omitted and the turbine wheel 412 of this embodiment may be an uncooled turbine wheel, where the internal cavity 422 is uncooled and effectively provides an insulating buffer.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A turbine engine comprising:

a turbine wheel including:

a rotor disk;

a plurality of turbine blades each operatively connected to the rotor disk through a blade mount with the blade mount bonded to the rotor disk and the blade mount and the rotor disk having a fore surface on a higher pressure side thereof and an aft surface on a lower pressure side thereof, wherein the blade mount comprises a blade attachment surface extending between and connecting the fore surface and the aft surface thereof with the turbine blade extending from the blade attachment surface;

a gap defined between adjacent blade mounts separating the blade mounts and extending into the rotor disk with the gap including a pocket having a fore opening in the fore surface, and the gap further including a rotor relief hole defined by and within the rotor disk and having a rotor relief opening in the fore surface;

a plug disposed in the rotor relief opening; and a pocket seal disposed in the pocket; and a fore seal plate having a fore plate edge abutting the blade mounts about a circumference of the turbine wheel and a finger extending toward and contacting the plug to maintain the plug in the rotor relief opening.

2. The turbine engine of claim 1, wherein the finger is aligned with the rotor relief hole.

3. The turbine engine of claim 1, wherein the rotor relief hole defines a longitudinal axis and the finger extends along the longitudinal axis.

4. The turbine engine of claim 1, wherein the plug has a cap and a body extending from the cap with the body extending into the rotor relief hole, and the finger contacts the cap to maintain the plug in the rotor relief opening.

5. The turbine engine of claim 1, wherein the pocket seal extends to the fore opening.

6. The turbine engine of claim 1, wherein the rotor relief hole is connected to the pocket internally between the blade mount and the rotor disk.

7. The turbine engine of claim 6, wherein the pocket seal extends to the rotor relief hole.

8. The turbine engine of claim 1, wherein the pocket seal contacts the plug.

9. The turbine engine of claim 1, wherein the pocket is free from an aft opening in the aft surface such that the pocket remains entirely closed at the aft surface of the adjacent blade mounts.

10. The turbine engine of claim 1, wherein the pocket has only the fore opening to enable insertion of the pocket seal into the pocket.

11. The turbine engine of claim 1, further comprising a radial seal seated between the fore seal plate and the blade mounts adjacent the fore plate edge and abutting the pocket seal to enhance sealing at the fore plate edge.

12. The turbine engine of claim 1, wherein the blade mount is bonded to the rotor disk in the absence of a mechanical connection.

13. The turbine engine of claim 1, wherein the pocket has a radially inward surface proximal the rotor disk and a radially outward surface distal to the rotor disk, and wherein the pocket seal is disposed along the radially outward surface.

14. The turbine engine of claim 1, wherein the rotor relief hole is separate and spaced apart from the pocket in the blade mount.

15. The turbine engine of claim 1, wherein the pocket is free from an opening in the blade attachment surface of the blade mount.

* * * * *